US007345423B2

(12) United States Patent
Nelson et al.

(10) Patent No.: US 7,345,423 B2
(45) Date of Patent: Mar. 18, 2008

(54) ASSEMBLY OF A FLUORESCENT LAMP AND AN EXTENSION MEANS

(75) Inventors: Gregory John Nelson, Samutprakarn (TH); Taworn Jiravorapate, Samuth Sakorn (TH)

(73) Assignee: Koninklijke Philips Electronics, N.V., Eindhoven (NL)

( * ) Notice: Subject to any disclaimer, the term of this patent is extended or adjusted under 35 U.S.C. 154(b) by 136 days.

(21) Appl. No.: 10/553,559

(22) PCT Filed: Apr. 20, 2004

(86) PCT No.: PCT/IB2004/050471

§ 371 (c)(1),
(2), (4) Date: Oct. 19, 2005

(87) PCT Pub. No.: WO2004/095503

PCT Pub. Date: Nov. 4, 2004

(65) Prior Publication Data

US 2007/0001573 A1 Jan. 4, 2007

(30) Foreign Application Priority Data

Apr. 22, 2003 (EP) ..... 03101097

(51) Int. Cl.
*H01J 17/20* (2006.01)

(52) U.S. Cl. ..... 313/571; 315/58; 315/129

(58) Field of Classification Search ..... 315/57, 315/58, 59, 62, 71, 129, 291; 313/483, 484, 313/564, 565, 566, 567, 568, 570, 571, 637, 313/638, 639, 641, 643
See application file for complete search history.

(56) References Cited

U.S. PATENT DOCUMENTS

| | | | | | |
|---|---|---|---|---|---|
| 3,290,538 | A | * | 12/1966 | Walsh et al. | 313/493 |
| 3,780,329 | A | * | 12/1973 | Otsuka et al. | 313/485 |
| 3,808,495 | A | * | 4/1974 | Win | 313/110 |
| 4,163,176 | A | * | 7/1979 | Cohen et al. | 315/53 |
| 4,475,064 | A | | 10/1984 | Burgess | |
| 4,758,173 | A | * | 7/1988 | Northrop | 439/232 |
| 5,013,962 | A | * | 5/1991 | Desclos | 313/318.02 |
| 5,105,125 | A | | 4/1992 | Yang | |
| 5,247,228 | A | * | 9/1993 | Roche | 315/53 |
| 5,623,184 | A | | 4/1997 | Rector | |

(Continued)

FOREIGN PATENT DOCUMENTS

DE 3329950 A1 2/1985

(Continued)

*Primary Examiner*—Thuy Vinh Tran

(57) ABSTRACT

An energy-saving assembly of an elongate low-pressure mercury vapor discharge lamp (1) and at least one elongate extension (2). The low-pressure mercury vapor discharge lamp includes a light-transmitting discharge vessel (10) enclosing, in a gastight manner, a discharge space (15) provided with a filling of mercury and a rare gas mixture. The rare gas mixture includes at least 50% by volume of krypton. The discharge vessel is provided with a luminescent layer (13). Electrodes (4*a;* 4*b*) are arranged in the discharge space for maintaining a discharge in the discharge space. The extensions are provided for connection to the low-pressure mercury vapor discharge lamp. The extension includes an inductance (3). The length of the low-pressure mercury vapor discharge lamp together with the length of the extension is adapted to fit a pre-determined mounting distance of tow-pressure mercury vapor discharge lamps.

13 Claims, 4 Drawing Sheets

U.S. PATENT DOCUMENTS 5,904,415 A * 5/1999 Robertson et al. ..... 362/260
6,002,200 A * 12/1999 Keim et al. ..... 313/318.02
6,304,029 B1 * 10/2001 De Bot et al. ..... 313/493
6,369,502 B1 * 4/2002 Auber et al. ..... 313/489
6,376,991 B1 4/2002 Sundaram et al.
6,400,097 B1 * 6/2002 Jin et al. ..... 315/246
6,465,960 B2 * 10/2002 Van Duivendijk et al. .... 315/56

FOREIGN PATENT DOCUMENTS

EP 0415738 A2 3/1991
EP 1094690 A2 4/2001
JP 09266040 A 10/1997

* cited by examiner

ASSEMBLY OF A FLUORESCENT LAMP AND AN EXTENSION MEANS

This Application is a National Phase Application under 35 U.S.C. 371 claiming the benefit of PCT/IB04/50471 filed on Apr. 20, 2004, which has priority based on European Patent Office (EPO) Application No. 03101097.8 filed on Apr. 22, 2003.

The invention relates to an assembly of an elongate low-pressure mercury vapor discharge lamp and at least one elongate extension means.

The invention also relates to a low-pressure mercury vapor discharge lamp for use in the assembly.

The invention also relates to an extension means for use in the assembly.

In mercury vapor discharge lamps, mercury constitutes the primary component for the (efficient) generation of ultraviolet (UV) light. A luminescent layer comprising a luminescent material (for example, a fluorescent powder) may be present on an inner wall of the discharge vessel to convert UV to other wavelengths, for example, to UV-B and UV-A for tanning purposes (sun panel lamps) or to visible radiation for general illumination purposes. Such discharge lamps are therefore also referred to as fluorescent lamps. The discharge vessel of a low-pressure mercury vapor discharge lamp is usually tubular and circular in cross-section.

In recent years much knowledge has been gained about (elongate) low-pressure mercury vapor discharge lamps, for instance TLD lamps, and their properties. Low-pressure mercury vapor discharge lamps are well established in the market. In general, two varieties of low-pressure mercury vapor discharge lamps exist. A first group of low-pressure mercury vapor discharge lamps comprises "standard" colors with a luminescent layer comprised of halophosphate material with relatively low lumens and a relatively low efficacy (lm/W), as well as a relatively low maintenance and a relatively low color rendering. A second group of low-pressure mercury vapor discharge lamps comprises so-called tri-phosphor lamps with a luminescent layer comprised of three or more rare-earth-containing phosphors with a relatively high lumen output, a relatively high efficacy (lm/W), a better maintenance, and an improved color rendering. Users of the first group of low-pressure mercury vapor discharge lamps are often reluctant to switch to the second group of low-pressure mercury vapor discharge lamps with the tri-phosphor technology because these discharge lamps represent a substantial investment with relatively little cash payback, in that the low-pressure mercury vapor discharge lamps of the second group give more light, but no energy savings in an existing installation. For this reason sales of fluorescent lamps with tri-phosphor technology are primarily driven by new installations. The market for "standard" color low-pressure mercury vapor discharge lamps is driven primarily by cost and these products have become commodities with vanishing margins.

An assembly of an elongate low-pressure mercury vapor discharge lamp and at least one elongate extension means is known from U.S. Pat. No. 4,163,176. In the known assembly, a fluorescent lamp having an extension base at one end thereof containing an impedance is provided for reducing a current flow through the discharge lamp. The length of the discharge lamp plus extension base equals the length of "standard" fluorescent low-pressure mercury vapor discharge lamps.

It is an object of the invention to provide an assembly of an elongate low-pressure mercury vapor discharge lamp and at least one elongate extension means which consumes less energy. According to the invention, an assembly of an elongate low-pressure mercury vapor discharge lamp and at least one elongate extension means is provided:

the low-pressure mercury vapor discharge lamp comprising:

- a light-transmitting discharge vessel enclosing, in a gastight manner, a discharge space provided with a filling of mercury and a rare gas mixture,
- the rare gas mixture comprising at least 50% by volume of krypton,
- the discharge vessel being provided with a luminescent layer,
- electrodes being arranged in the discharge space for maintaining a discharge in the discharge space, the elongate extension means being provided for connection to the low-pressure mercury vapor discharge lamp, the extension means comprising an inductance, the length of the low-pressure mercury vapor discharge lamp together with the length of the extension means being adapted to fit a pre-determined mounting distance of low-pressure mercury vapor discharge lamps.

The inventors have recognized how to reduce the wattage of the low-pressure mercury vapor discharge lamp by reducing the lamp length while maintaining the retrofittability in a "standard" low-pressure mercury vapor discharge lamp system with a pre-determined mounting distance. According to the invention, a low-pressure mercury vapor discharge lamp with a reduced length of the discharge vessel and with a relatively high krypton content in the rare gas mixture is provided in combination with an extension means comprising an inductance. In order to maintain retrofittability in "standard" low-pressure mercury vapor discharge lamp systems, an elongate extension means is fitted to one or to both ends of the low-pressure mercury vapor discharge lamp in the assembly according to the invention such that the assembly of the low-pressure mercury vapor discharge lamp and the extension means fits in existing fixtures and complies with discharge lamp length standards.

An advantage of providing an elongate extension means is that additional electronic components can be incorporated in the extension means. Such electronic components further adjust electrical parameters of the low-pressure mercury vapor discharge lamp system in a favorable manner. The inductance provided in the extension means acts to reduce the current in the entire assembly resulting in power savings both in the low-pressure mercury vapor discharge lamp and in the external ballast circuit.

The assembly according to the invention allows users to upgrade their discharge lamp systems with lower wattage while yielding substantially the same lumens and a substantial saving in operating costs. Additional benefits include improved lumen maintenance (higher average lumens), longer life, and lower mercury content, as well as reduced waste upon disposal. The assembly according to the invention has the additional advantage that, due to the lower voltage of the discharge lamp and a shorter discharge length, it improves some of the issues hampering users in countries with unstable line voltage, such as better ignition and lower extinction voltage.

Preferably, the rare gas mixture in the discharge vessel of the low-pressure mercury vapor discharge lamp comprises at least 80% by volume of krypton. Additional wattage reduction is achieved by increasing the amount of krypton in the rare gas mixture. In an alternative embodiment, xenon is employed instead of krypton.

A preferred embodiment of the assembly according to the invention is characterized in that the gas pressure in the discharge vessel of the low-pressure mercury vapor discharge lamp is between $10^5$ and $4 \cdot 10^5$ Pa (between 1 and 4 bar), preferably between $2 \cdot 10^5$ and $3 \cdot 10^5$ Pa (between 2 and 3 bar). Although a filling pressure higher than $3 \cdot 10^5$ Pa will result in an additional wattage reduction and a slightly lower efficacy it will cause difficult ignition on many ballast systems. Pressures lower than $2 \cdot 10^5$ Pa could enhance starting and efficacy, but wattage and lumens would be higher, so a higher krypton content and/or inductance in the extension means would be necessary to reduce the wattage. Lifetime will also be reduced with lower filling pressure. Generally speaking, requirements with respect to rare gas mix, filling pressure and inductance are interrelated. The desired wattage reduction can be achieved in a number of ways, with consequences for lifetime, lumens, efficacy, and ignition. A particularly preferred range is from $2 \cdot 10^5$ to $2.4 \cdot 10^5$ Pa.

Experiments have shown that the inductance can be chosen such that the power savings in the external ballast circuit are greater than or equal to the power losses in the extension means. To this end, a preferred embodiment of the assembly according to the invention is characterized in that the impedance of the inductance in the extension means is in a range of between 5% and 30% of the inductance of an external ballast circuit for the low-pressure mercury vapor discharge lamp. A relative impedance of the inductance in the extension means greater than 30% is too large and would reduce by too great a factor the light output of the low-pressure mercury vapor discharge lamp. The absolute value of the impedance of the inductance in the extension means for a TL40/TLD36 inductive ballast system (390 Ohms) is in the range from 20 to 120 Ohms at a frequency of 50 Hz. A preferred value of the relative impedance of the inductance in the extension means is 15%, corresponding to a value of approximately 60 Ohms at 50 Hz. Other values apply for lamps systems of different wattage, e.g. 18 W and 58 W.

In a preferred embodiment of the assembly according to the invention, the ratio of the length $l_{em}$ of the extension means to the length $l_{dl}$ of the low-pressure mercury vapor discharge lamp is in a range of:

$$0.8 \leq \frac{l_{dl}}{l_{dl+l_{em}}} \leq 0.98.$$

If the length of the low-pressure mercury vapor discharge lamp is reduced by more than 20%, a substantial "dark" area will be present in the fixture. In addition, the light distribution will be adversely affected. In keeping with these requirements it is desirable not to reduce lamp length by more than 10%. Preferably, the length of the low-pressure mercury vapor discharge lamp is in a range from 0.92 and 0.97.

The extension means may form an integral part of the low-pressure mercury vapor discharge lamp or may be supplied separately for re-use. In an alternative, preferred embodiment of the assembly according to the invention, the extension means comprises two elongate extension parts, the length of the low-pressure mercury vapor discharge lamp together with the lengths of the two extension parts being such as to fit the predetermined mounting distance of low-pressure mercury vapor discharge lamps. In a further alternative, preferred embodiment of the assembly according to the invention, the extension means forms an integral part of the low-pressure mercury vapor discharge lamp.

According to the invention as described above, the extension means is used to reduce the current in the low-pressure mercury vapor discharge lamp in order to achieve the desired wattage reduction. The space for the extension means is made available by the reduced length of the low-pressure mercury vapor discharge lamp itself.

An additional problem of the assembly of the low-pressure mercury vapor discharge lamp and the extension means containing the inductance is that the inductance will be in series with one pin issuing from a lamp cap of the low-pressure mercury vapor discharge lamp when the extension means is assembled with the low-pressure mercury vapor discharge lamp. When the assembly of the low-pressure mercury vapor discharge lamp and the extension means is placed in an existing luminaire, it may be inserted in four different orientations. With respect to the external ballast circuit, the inductance will alternately be installed in the external ballast circuit ("desired" installation) or in the external starter circuit ("misapplication"). It is an additional object of the invention to provide a solution whereby the customer is notified if the installation is wrong and/or the situation is self-correcting.

To this end, a preferred embodiment of the assembly according to the invention is characterized in that the extension means is provided with an indicator means for indicating the status of the connection between the extension means and an external ballast circuit and an external starter circuit for the low-pressure mercury vapor discharge lamp.

A favorable way to provide the indicator means is that the indicator means comprises a light emitting diode (LED) connected across turns of the inductance. The indicator means may either be a positive indicator (desired installation) or a negative indicator (misapplication). An example of a "positive" indicator means is a (green) LED connected across (several turns of) the inductance in the extension means. The voltage generated across the (turns of the) inductance during proper lamp operation causes the LED to glow green. If the extension means is installed "wrongly", such that the inductance is in the external starter circuit, no current will flow in the inductance during lamp operation and the LED will not light up.

An alternative, favorable way to provide the indicator means is that the extension means comprises a resistor and the indicator means comprises a light emitting diode (LED) connected across the resistor. If the resistor is in the external starter circuit (desired installation), current will flow only during starting of the low-pressure mercury vapor discharge lamp. With a "wrong" installation (inductance in the external starter circuit and resistor together with LED in the external ballast circuit), current will flow through the resistor, thus generating a voltage which will light the LED.

An embodiment of the assembly according to the invention is characterized in that the indicator means comprises a thermal indicator. Such thermal indicators are also used in some batteries to indicate their charging state. The thermal indicator may either be a "positive" indicator triggered by the heat generated by the inductance or a "negative" indicator triggered by the heat generated by a resistance placed in the non-inductive circuit of the extension means. This embodiment of the invention is robust and inexpensive but may have a relatively slow response time (the discharge lamp has to burn for several minutes to get an indication).

A very favorable solution involves an automatic switching adapter. To this end the extension means comprises an automatic switching adapter providing that the inductance is automatically connected to the external ballast circuit independently of the installation orientation after the extension means have been connected to the low-pressure mercury vapor discharge lamp and the assembly has been placed in a "standard" external ballast circuit and a "standard" external starter circuit.

These and other aspects of the invention are apparent from and will be elucidated with reference to the embodiments described hereinafter.

IN THE DRAWINGS

FIG. 4 shows an elongate extension means provided with an automatic switching adapter according to the invention, and.

The Figures are purely diagrammatic and not drawn to scale. Notably, some dimensions are shown in a strongly exaggerated form for the sake of clarity. Similar components in the Figures are denoted as much as possible by the same reference numerals.

Figure 1A:
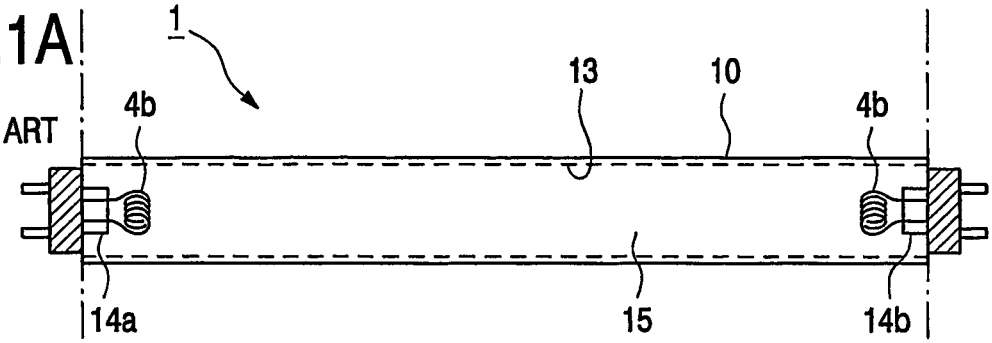
Fig.1A PRIOR ART
FIG. 1A is a cross-sectional view of an elongate low-pressure mercury-vapor discharge lamp according to the prior art.

FIG. 1A is a diagrammatic a cross-sectional view of an elongate low-pressure mercury-vapor discharge lamp 1 according to the prior art. The prior art low-pressure mercury vapor discharge lamp 1 comprises a light-transmitting discharge vessel 10. The discharge vessel 10 encloses a discharge space 15 in a gastight manner. Electrodes 4*a*; 4*b* mounted on end portions 14*a*; 14*b* are arranged in the discharge space 15 for maintaining a discharge in the discharge space 15. The electrodes 4*a*; 4*b* are windings of tungsten covered with an electron-emitting substance, normally a mixture of barium oxide, calcium oxide and strontium oxide. Current-supply conductors extend from the electrodes 4*a*; 4*b*, pass through the end portions 14*a*; 14*b*, and issue to outside the discharge vessel 10. The discharge space 15 is provided with a filling of mercury and a rare gas mixture. In addition, the discharge vessel 10 is provided with a luminescent layer 13. The luminescent layer 13 is preferably provided on a surface of the discharge vessel 10 facing the discharge space 15. The luminescent layer 13 includes a luminescent material (for example a fluorescent powder) which converts the ultraviolet (UV) light generated by fallback of the excited mercury into (generally) visible light. The length of the prior art low-pressure mercury vapor discharge lamp 1 in FIG. 1A is fixed to a pre-determined mounting distance $l_{md}$ of low-pressure mercury vapor discharge lamps.

Figure 1B:
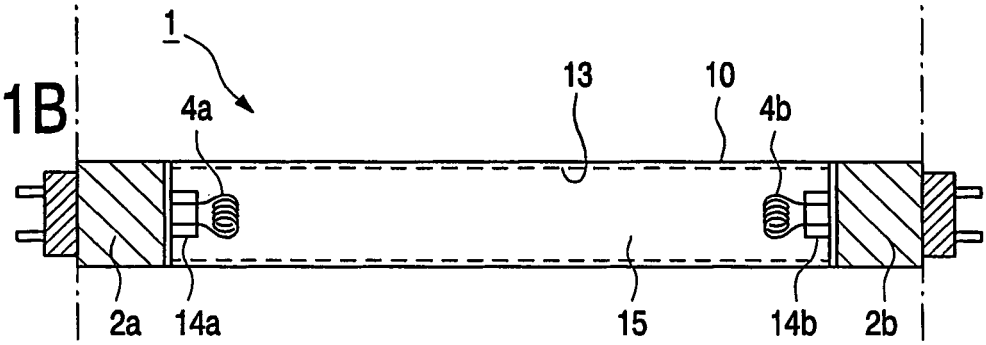
FIG. 1B is a cross-sectional view of an assembly according to the invention with an elongate low-pressure mercury vapor discharge lamp and with two elongate extension means.

FIG. 1B is a diagrammatic a cross-sectional view of an assembly according to the invention with an elongate low-pressure mercury vapor discharge lamp 1 and with two elongate extension means 2*a*, 2*b*. The rare gas mixture in the discharge vessel 10 comprises at least 50% by volume of krypton. Preferably, the gas mixture comprises at least 80% by volume of krypton. The elongate extension means 2*a*; 2*b* are provided for connection to the low-pressure mercury vapor discharge lamp 1. The length $l_{dl}$ of the low-pressure mercury vapor discharge lamp 1 together with the lengths $l_{em}$ of the two extension means 2*a*; 2*b* is adapted to fit the pre-determined mounting distance $l_{md}$ of low-pressure mercury vapor discharge lamps. The length of the extension means with reference numeral 2*a* may be different from the length of the extension means with reference numeral 2*b*.

Figure 1C:
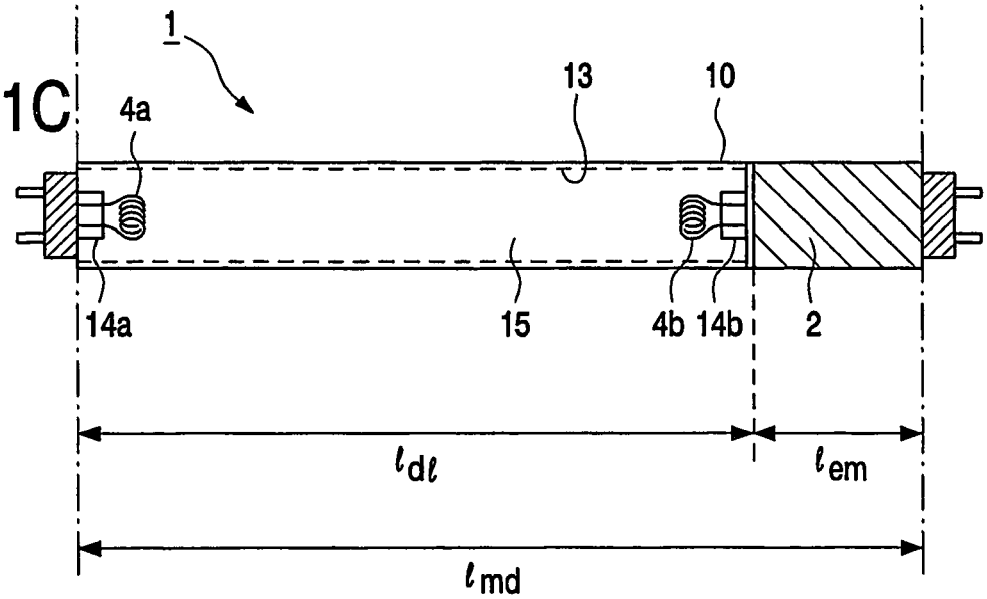
FIG. 1C is a cross-sectional view of an assembly according to the invention with an elongate low-pressure mercury vapor discharge lamp and with one elongate extension means.

FIG. 1C is a schematic a cross-sectional view of an assembly according to the invention with an elongate low-pressure mercury vapor discharge lamp 1 and with one elongate extension means 2. The rare gas mixture in the discharge vessel 10 comprises at least 50% by volume of krypton. Preferably, the gas mixture comprises at least 80% by volume of krypton. The elongate extension means 2 is provided for connection to the low-pressure mercury vapor discharge lamp 1. The length $l_{dl}$ of the low-pressure mercury vapor discharge lamp 1 together with the length $l_{em}$ of the extension means 2 is adapted to fit the pre-determined mounting distance $l_{md}$ of low-pressure mercury vapor discharge lamps, in other words $l_{dl}+l_{em}=l_{md}$.

According to the invention, the wattage of the low-pressure mercury vapor discharge lamp is reduced owing to the lamp length while maintaining the retrofittability in a "standard" low-pressure mercury vapor discharge lamp system with a predetermined mounting distance. The low-pressure mercury vapor discharge lamps according to the invention as shown in FIGS. 1B and 1C fits in existing fixtures and complies with lamp length standards. The space for the extension means 2 is provided by the reduced length of the low-pressure mercury vapor discharge lamp 1.

Preferably, the ratio of the length $l_{em}$ of the extension means to the length $l_{dl}$ of the low-pressure mercury vapor discharge lamp is in a range of:

$$0.8 \leq \frac{l_{dl}}{l_{dl}+l_{em}} \leq 0.98,$$

Preferably, the length of the low-pressure mercury vapor discharge lamp is in a range from 0.92 to 0.97. In experiments, the length reduction was approximately 5%, leaving ample space to incorporate the desired electronic components (e.g. the inductance) in the extension means.

The elongate low-pressure mercury vapor discharge lamp 1 in FIG. 1A has a "standard" length of $l_{md}$=1200 mm if it is of the standard 36W TLD design. By way of example, a favorable length of the energy-saving low-pressure mercury vapor discharge lamp 1 lamp of FIGS. 1B and 1C is $l_{dl}$=1150 mm (length reduction is approximately 4.2%). The corresponding length of the extension means 2 in FIG. 1C is $l_{em}$=50 mm.

The following data are given by way of example. In all cases presented below, the low-pressure mercury vapor discharge lamp referred to comprises a luminescent layer on the basis of tri-phosphor technology in a mixture to give a color temperature of 6,500K on the black body locus. A length reduction of 50 mm alone gives a low-pressure mercury vapor discharge lamp in an assembly according to the invention with a lamp voltage 97 V, a lamp current of 449 mA, a lamp wattage of 35.6 W, and a lamp efficacy of 86.5 lm/W as compared with a TLD36 with a lamp voltage of 103 V, a lamp current of 440 mA, a lamp wattage of 36.5 W, and a lamp efficacy of 85 lm/W. If, in addition, the rare gas mixture is adjusted from $3\cdot10^5$ Pa/75% Kr to $2.4\cdot10^5$ Pa/90% Kr, this gives a lamp voltage of 92 V, a lamp current of 456 mA, a lamp wattage of 34.5 W, and a lamp efficacy of 85.6 lm/W for the low-pressure mercury vapor discharge lamp in the assembly according to the invention. Addition of a 60 Ω impedance results in a relatively large reduction in wattage. For a low-pressure mercury vapor discharge lamp with a rare gas mixture of $2.0\cdot10^5$ Pa/75% Kr this results in a lamp voltage of 102.4 V, a lamp current of 377 mA, a lamp wattage of 31.8 W, and a lamp efficacy of 88.2 lm/W. For a low-pressure mercury vapor discharge lamp with a rare gas mixture of $2.4\cdot10^5$ Pa/90% Kr this results in a lamp voltage of 96.8 V, a lamp current of 384 mA, a lamp wattage of 30.6 W, and a lamp efficacy of 88.5 lm/W. The presence of the additional impedance results in an increased efficacy. In addition, the savings in system current through the external ballast circuit result in power savings that offsets any losses generated in the inductance present in the extension means. In the absence of an additional inductance, the wattage of the discharge lamp is reduced only slightly and this will be offset by additional heating losses in the external ballast circuit due to increased lamp current resulting in minimal, if any, system wattage reduction. For a low-pressure mercury vapor discharge lamp with a length reduction of 50 mm and a rare gas mixture filling of $2.4\cdot10^5$ Pa/90% Kr and comprising a luminescent layer with tri-phosphor technology and a color temperature of 6,500K on the black body locus, the lamp efficacy is approximately 26% higher than that of the "standard" daylight color low-pressure mercury vapor discharge lamp TLD36/54. In this case, the lamp wattage has been reduced by 16.2%. The energy-saving low-pressure mercury vapor discharge lamp in this preferred embodiment of the assembly still emits substantially more lumens than the "standard" lamp. These extra lumens can be used for additional wattage savings, as an additional market advantage over "standard" color, or as a means for reducing product cost (savings in phosphor materials because lower lumen/efficacy target is needed to give same luminous as "standard" color). Efficacy comparisons are given for illustration only and may differ for other chromaticities.

A reduced length of 50 mm gives the low-pressure mercury vapor discharge lamp, in operation, a discharge voltage of approximately 97 V (as against 103 V for a "standard" low-pressure mercury vapor discharge lamp) and a wattage of the discharge lamp on TLD36/TL40 ballast circuits of approximately 35.6 W (as against 36.5 W for a "standard" low-pressure mercury vapor discharge lamp).

The invention has the additional advantage that it eliminates some of the issues hampering users in countries with unstable line voltage from converting from TL to TLD. The first issue involves the more difficult nature of TLD lamp ignition due to the Kr gas filling. In the lamp design mentioned above, the reduced discharge length and lower lamp voltage will serve to reduce the starting requirements. The second issue involves the extinction voltage of the lamp. Operating TLD lamps normally extinguish when the line voltage is reduced to below approximately 155 V as compared with approximately 140 V for TL. The reduced lamp voltage of the discharge vessel with reduced length largely eliminates this performance difference. This implies that the invention allows many users to upgrade from 40 W to 30 W systems yielding the same lumens and saving 25% of operating costs. Additional benefits include improved lumen maintenance (higher average lumens), longer life, and lower mercury content, as well as reduced waste upon disposal.

Figure 2:
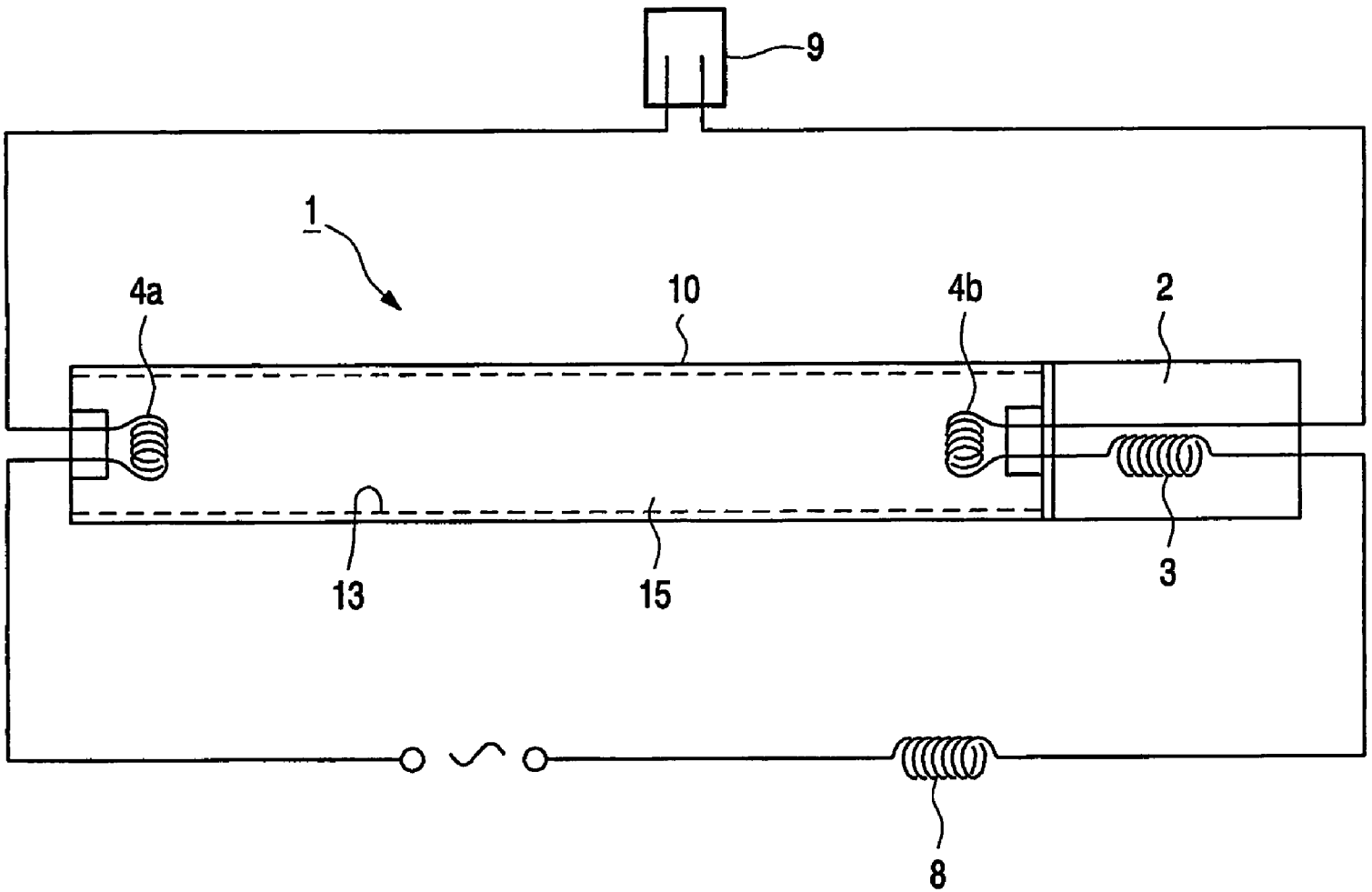
FIG. 2 shows an assembly according to the invention with an elongate low-pressure mercury vapor discharge lamp and an elongate extension means connected to an external starter circuit and an external ballast circuit.

FIG. 2 shows an elongate low-pressure mercury vapor discharge lamp 1 provided with an elongate extension means 2 according to the invention connected to an external starter circuit 9 and an external ballast circuit 8. In the example of FIG. 2, the external starter circuit 9 is a so-called glow-switch starter. The extension means 2, preferably, provides the means for reducing the current through the discharge lamp and assists in achieving the desired wattage. To this end, the extension means 2 comprises an inductance 3. Preferably, the impedance of the inductance 3 in the extension means 2 is in a range between 5% and 30% of the inductance of an external ballast circuit 8 for the low-pressure mercury vapor discharge lamp. A favorable combination of the extension means 2 comprising a 60 Ω inductive impedance combined with a reduction in lamp length of 60 mm gives approximately 30.5 W in the discharge lamp when combined with a "standard" external ballast circuit.

The extension means 2 with inductance 3 according to the invention is feasible both economically and in size (for example fits in a tubular package of T8 diameter in the length made available by the lamp length reduction). In addition, the extension means 2 may be designed to mate with a special cap at one end of the low-pressure mercury vapor discharge lamp 1 with a reduced length of its discharge vessel 10. In addition, the discharge lamp and the extension means 2 may be locked together, integrally forming a single unit that in every respect fulfils the dimensional requirements of a "standard" TLD36 low-pressure mercury vapor discharge lamp. The extension means 2 with inductance 3 has a relatively long lifetime due to the absence of active electrical components inside. This will enable the adapter to be re-used over many lamp lives, thus increasing the payback of such an assembly for the customer.

The use of an extension means 2 according to the invention creates an additional source of system losses due to the heat generated in the turns of the inductance 3. However, the inductance 3 also reduces the current in the entire assembly resulting in power savings in the external ballast circuit 8. It was shown in feasibility studies that the design can be chosen such that the power savings in the external ballast circuit 8 are greater than or equal to the power losses in the extension means 2.

A number of embodiments will now be presented in order to enable the customer to discern whether the installation of the extension means has been performed correctly.

Figure 3A:
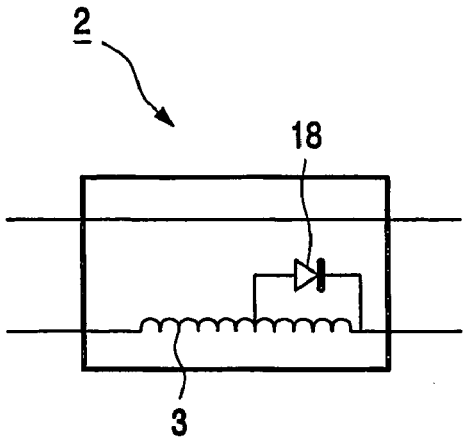
FIG. 3A shows an elongate extension means provided with an indicator means according to the invention.

A "positive" indicator is used in a first embodiment a". FIG. 3A shows an elongate extension means provided with an indicator means 2 according to the invention. In the example of FIG. 3A, the indicator means 18 is a (green) light emitting diode (LED) connected across several turns of the inductance 3 in the extension means 2. The voltage generated across these turns during proper lamp operation will cause the LED to glow (green). If the extension means 2 is installed "wrongly", such that the inductance is in the external starter circuit 9, no current will flow in the inductance 3 during lamp operation and the LED will not light. Note that the LED might flicker during starting in both "right" and "wrong" installations. If the user/installer notes that the LED is not lit during operation, he may either rotate the discharge lamp in the fixture or—if a switch is provided on the adapter—move the switch to the opposite position.

Figure 3B:
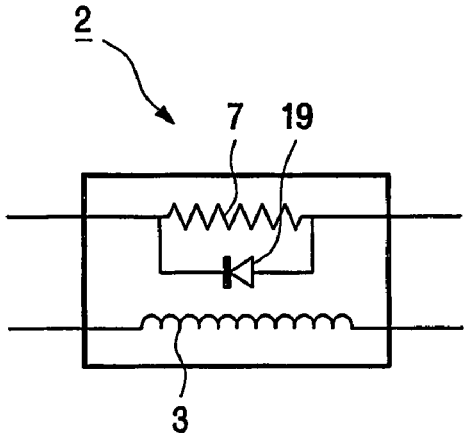
FIG. 3B shows an elongate extension means provided with an alternative indicator means according to the invention.

In a second embodiment, a "negative" indicator is used. FIG. 3B shows an elongate extension means 2 provided with an alternative indicator means according to the invention. In the example of FIG. 3B, the indicator means 19 is a (red) LED connected across a resistor 7 inserted in the line parallel to the line in the extension means 2 containing the inductance 3. If the resistor 7 is in the external starter circuit 9 (correct installation), current only flows during starting the discharge lamp. While this low ohmic resister will reduce the starting current slightly, this will have only a minor effect on starting behavior and can be compensated for in the lamp coil design. With a "right" adapter installation, the red LED may flicker during starting, but will be off during lamp operation. With a "wrong" installation (the inductance 3 in the external starter circuit 9 and the resistor 7 together with LED in the external ballast circuit), current will flow through the resistor 7, thus generating a voltage which will light the LED. The LED will light up only during incorrect installation (resistor 7 does not cause losses in correct installation). In incorrect installation, the resistor 7 can also help to limit excessive current being drawn from the external ballast circuit 8 (making up for some/all of the missing lamp voltage from reduced lamp length). With this type of indicator means 19, the user/installer will have to look for red LEDs after installation and rotate the respective lamps or move a switch on the associate adapter to the opposite position.

In a third embodiment, as an alternative for the LED indicators is to use a thermal indicator (as used in some batteries to indicate the charging state). This may either be a "positive" indicator triggered by the heat generated by the inductance or a "negative" indicator triggered by the heat generated by a resistance placed in the non-inductive circuit of the adapter. Such a solution is robust and inexpensive, but may have a relatively slow response time (the discharge lamp has to burn for several minutes to get an indication).

In yet another embodiment, equal inductances are placed in both circuits of the extension means. This may consist of, for example, a coiled coil. Such a doubling will not increase losses but increases the size, weight and cost of the extension means. It will also have a strong negative effect on the preheating current during ignition.

Figure 4:
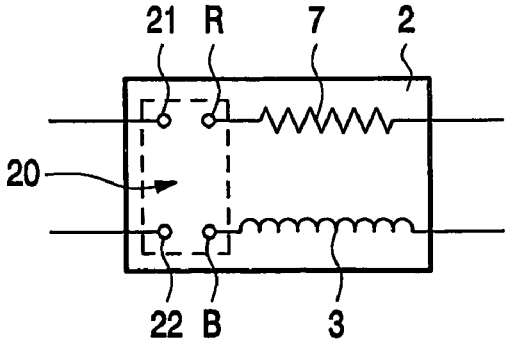
Figure 5B:
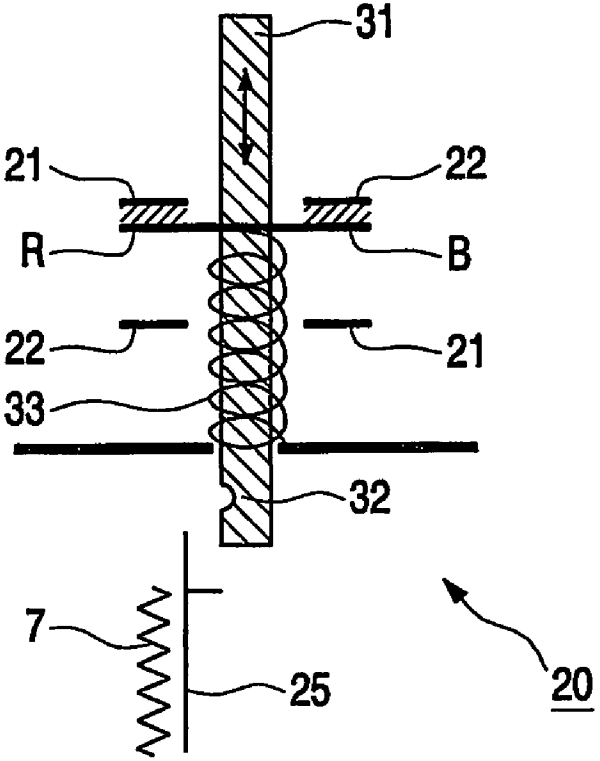
FIGS. 5A and 5B shows two switching modes of the extension means in FIG. 4.
Figure 5A:
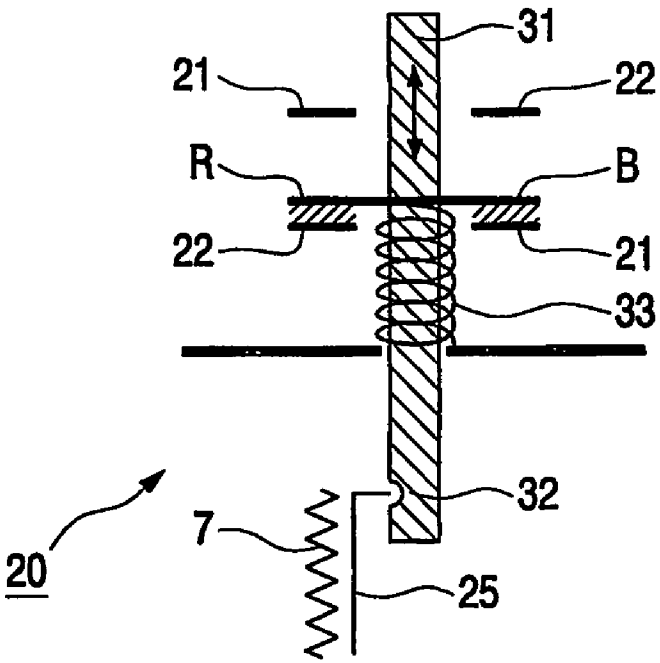

A very favorable embodiment involves an automatic switching adapter. FIG. 4 shows an elongate extension means provided with an automatic switching adapter 20 according to the invention. In addition, FIGS. 5A and 5B shows two switching modes of the extension means 2 of FIG. 4. In the example of FIGS. 5A and 5B, the automatic switching adapter 20 is embodied in the form of a switch 31 which is loaded by a spring 33. In the switching mode of FIG. 5A, the switch 31 is cocked to a position in which the spring 33 is under tension. The switch 31 is held in this position by a small catch 32 attached to a bimetal strip 25. In the example of FIG. 5A, a resistor 7 inserted in the non-inductive circuit of the extension means 2 is thermally coupled to this bimetal strip 25. If the extension means 2 is installed correctly, this resistor 7 will only generate a small amount of heat during lamp ignition, which heat will be insufficient for moving the bimetal strip 25 and releasing the catch 32 on the switch 31. If the extension means 2 is installed incorrectly, the lamp current will flow through the resistor 7 coupled to the bimetal strip 25. After some minutes, the bimetal strip 25 will reach a sufficient temperature such that the deflection of the bimetal strip 25 releases the catch 32 on the spring 33 loaded switch 31. This will cause the switch 31 to move to the opposite position (see the arrows in FIGS. 5A and 5B), thus connecting the inductance 3 correctly to the external ballast circuit 8 and placing the resistor 7 together with the bimetal strip 25 in the external starter circuit 9. Switching will occur only once and only in 50% of installed adapters (others will remain in cocked position). When the low-pressure mercury vapor discharge lamp 1 is removed at the end of lamp life, the switch 31 in the extension means 2 may be reset manually or automatically in the action of assembling the extension means with a new lamp and inserting them in the luminaire.

The benefits of the energy-saving low-pressure mercury vapor discharge lamp provided with extension means according to the invention include: approximately 15% lamp energy savings as compared with known TLD lamps and approximately 25% energy saving for known TL40 lamps. The lumen maintenance is higher than 90% at 12,000 hours, whereas for "standard" color lamps the lumen maintenance is typically 70% at 8,000 hours. In addition, the lifetime is longer, the ignition behavior is improved, and the extinction voltage is lower. In addition, the use of tri-phosphor technology results in lower mercury consumption over life, meaning that the energy-saving low-pressure mercury vapor discharge lamps can have a mercury dose less than half that of an equivalent "standard" color lamp, resulting in environmental benefits.

The measure according to the invention offers users of low-pressure mercury vapor discharge lamps with "standard colors" an incentive to switch to low-pressure mercury vapor discharge lamps with tri-phosphor technology.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. An assembly of an elongate low-pressure mercury vapor discharge lamp (1) and at least one elongate extension means (2), the low-pressure mercury vapor discharge lamp comprising:

a light-transmitting discharge vessel (10) enclosing, in a gastight manner, a discharge space (15) provided with a filling of mercury and a rare gas mixture, the rare gas mixture comprising at least 50% by volume of krypton, the gas pressure in the discharge vessel (10) being greater than $1 \cdot 10^5$ Pa, the discharge vessel (10) being provided with a luminescent layer (13), electrodes (4*a*; 4*b*) being arranged in the discharge space (15) for maintaining a discharge in the discharge space (15), the elongate extension means (2) being provided for connection to the low-pressure mercury vapor discharge lamp (1), the extension means (2) comprising an inductance (3), the length of the low-pressure mercury vapor discharge lamp (1) together with the length of the extension means (2) being adapted to fit a pre-determined mounting distance $l_{md}$ of low-pressure mercury vapor discharge lamps.

2. An assembly as claimed in claim 1, characterized in that the impedance of the inductance (3) in the extension means (2) is in a range between 5% and 30% of the inductance of an external ballast circuit (8) for the low-pressure mercury vapor discharge lamp.

3. An assembly as claimed in claim 1, characterized in that the gas pressure in the discharge vessel (10) of the low-pressure mercury vapor discharge lamp (1) is between $10^5$ and $4 \cdot 10^5$ Pa.

4. An assembly as claimed in claim 1, characterized in that a ratio of the length ($l_{em}$) of the extension means (2) to the length ($l_{dl}$) of the low-pressure mercury vapor discharge lamp (1) is in a range of.

$$0.8 \leq \frac{l_{dl}}{l_{dl} + l_{em}} \leq 0.98.$$

5. An assembly as claimed in claim 1, characterized in that the rare gas mixture in the discharge vessel (10) of the low-pressure mercury vapor discharge lamp (1) comprises at least 80% by volume of krypton.

6. An assembly as claimed in claim 1, characterized in that the extension means forms an integral part of the low-pressure mercury vapor discharge lamp.

7. An assembly as claimed in claim 1, characterized in that the extension means (2) comprises two elongate extension parts (2*a*, 2*b*), the length of the low-pressure mercury vapor discharge lamp (1) together with the lengths of the two extension parts (2*a*, 2*b*) being adapted to fit the pre-determined mounting distance of low-pressure mercury vapor discharge lamps.

8. An assembly as claimed in claim 1, characterized in that the extension means (2) is provided with an indicator means (18; 19) for indicating the status of the connection between the extension means (2) on the one hand and an external ballast circuit (8) and an external starter circuit (9) for the low-pressure mercury vapor discharge lamp (1) on the other hand.

9. An assembly as claimed in claim 8, characterized in that the indicator means (18) comprises a light emitting diode connected across turns of the inductance (3).

10. An assembly as claimed in claim 8, characterized in that the extension means (2) comprises a resistor (7), and in that the indicator means (19) comprises a light emitting diode connected across the resistor (7).

11. An assembly as claimed in claim 8, characterized in that both the external ballast circuit (8) and the external starter circuit (9) comprise an inductance.

12. An assembly as claimed in claim 8, characterized in that the indicator means comprises a thermal indicator.

13. An assembly as claimed in claim 1, characterized in that the extension means (2) comprises an automatic switching adapter (20) providing that, after the extension means (2) have been connected to the low-pressure mercury vapor discharge lamp (1) and the assembly has been placed in a standard external ballast circuit (8) and a standard external starter circuit (9), the inductance is automatically connected to the external ballast circuit (8) independently of installation orientation.

* * * * *